US011346042B2

(12) United States Patent
Lee et al.

(10) Patent No.: US 11,346,042 B2
(45) Date of Patent: May 31, 2022

(54) DRYING APPARATUS AND METHOD FOR CONTROLLING SAME

(71) Applicant: SAMSUNG ELECTRONICS CO., LTD., Suwon-si (KR)

(72) Inventors: Dong Gyu Lee, Suwon-si (KR); Young Uk Yun, Suwon-si (KR); Jin Woo Hong, Suwon-si (KR); Kwon Jin Kim, Suwon-si (KR); Byung Han Lim, Suwon-si (KR); Dong Sik Jin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 231 days.

(21) Appl. No.: 15/733,037

(22) PCT Filed: Oct. 26, 2018

(86) PCT No.: PCT/KR2018/012821
§ 371 (c)(1),
(2) Date: Apr. 24, 2020

(87) PCT Pub. No.: WO2019/083320
PCT Pub. Date: May 2, 2019

(65) Prior Publication Data

US 2020/0263346 A1 Aug. 20, 2020

(30) Foreign Application Priority Data

Oct. 26, 2017 (KR) ..... 10-2017-0140465

(51) Int. Cl.
*F26B 7/00* (2006.01)
*D06F 58/20* (2006.01)
(Continued)

(52) U.S. Cl.
CPC ..... *D06F 58/206* (2013.01); *D06F 58/34* (2020.02); *D06F 58/38* (2020.02); *D06F 34/26* (2020.02);
(Continued)

(58) Field of Classification Search
CPC ..... D06F 58/206; D06F 58/34; D06F 58/38; D06F 34/26; D06F 2103/32;
(Continued)

(56) References Cited

U.S. PATENT DOCUMENTS 9,803,313 B2 10/2017 Ryoo et al.
10,161,078 B2 12/2018 Xu et al.
(Continued)

FOREIGN PATENT DOCUMENTS

JP 2716780 B2 2/1998
KR 10-0762128 B1 10/2007
(Continued)

OTHER PUBLICATIONS

Written Opinion of the International Searching Authority dated Feb. 19, 2019 in corresponding International Patent Application No. PCT/KR2018/012821.
(Continued)

*Primary Examiner* — John P McCormack
(74) *Attorney, Agent, or Firm* — Staas & Halsey LLP

(57) ABSTRACT

A drying apparatus is disclosed. The drying apparatus comprises: a drum; a compressor for compressing a refrigerant; a first temperature sensor provided at an air discharge port of the drum; a second temperature sensor provided at a refrigerant discharge port of the compressor; and a processor which, when a drying cycle for an object to be dried begins, compares a first temperature sensed by the first temperature sensor with a predetermined threshold temperature so as to obtain an operation frequency of the compressor, and when
(Continued)

a second temperature sensed by the second temperature sensor reaches a predetermined first target temperature, adjusts the operation frequency of the compressor on the basis of a third temperature calculated on the basis of the first temperature and the second temperature.

15 Claims, 9 Drawing Sheets

(51) Int. Cl.

| | |
|---|---|
| ***D06F 58/38*** | (2020.01) |
| ***D06F 58/34*** | (2020.01) |
| *D06F 103/32* | (2020.01) |
| *D06F 103/50* | (2020.01) |
| *D06F 105/58* | (2020.01) |
| *D06F 34/26* | (2020.01) |
| *D06F 105/26* | (2020.01) |

(52) U.S. Cl.
CPC ..... *D06F 2103/32* (2020.02); *D06F 2103/50* (2020.02); *D06F 2105/26* (2020.02); *D06F 2105/58* (2020.02)

(58) Field of Classification Search
CPC ..... D06F 2103/50; D06F 2105/26; D06F 2105/58; F25B 49/022; F25B 49/025; F25B 2600/02; F25B 2600/021; F25B 2600/022; F25B 2600/025; F25B 2600/0253
USPC ..... 34/427; 62/215, 176.3, 228.4, 323.4
See application file for complete search history.

(56) References Cited

U.S. PATENT DOCUMENTS

| | | | | |
|---|---|---|---|---|
| 10,487,442 | B2 | 11/2019 | Han et al. | |
| 2012/0186305 | A1* | 7/2012 | Taniguchi | D06F 58/30 68/19 |
| 2015/0082658 | A1 | 3/2015 | Contarini et al. | |
| 2016/0040350 | A1* | 2/2016 | Xu | D06F 58/48 34/443 |
| 2017/0314181 | A1* | 11/2017 | Wakizaka | D06F 58/206 |
| 2018/0080169 | A1* | 3/2018 | Je | D06F 58/50 |

FOREIGN PATENT DOCUMENTS

| | | | |
|---|---|---|---|
| KR | 10-2011-0119934 | A | 11/2011 |
| KR | 10-2014-0107984 | A | 9/2014 |
| KR | 10-1579655 | B1 | 12/2015 |
| KR | 10-2016-0002914 | A | 1/2016 |
| KR | 10-1613966 | B1 | 4/2016 |
| KR | 10-2016-0059928 | A | 5/2016 |
| KR | 10-2016-0089563 | A | 7/2016 |
| KR | 10-2018-0057313 | A | 5/2018 |

OTHER PUBLICATIONS

International Search Report dated Feb. 19, 2019 in corresponding International Patent Application No. PCT/KR2018/012821.

* cited by examiner

100

DRYING APPARATUS AND METHOD FOR CONTROLLING SAME

CROSS-REFERENCE TO RELATED APPLICATIONS

This application is a U.S. National Stage Application which claims the benefit under 35 U.S.C. § 371 of International Patent Application No. PCT/KR2018/012821 filed on Oct. 26, 2018, which claims foreign priority benefit under 35 U.S.C. § 119 of Korean Patent Application No. 10-2017-0140465 filed on Oct. 26, 2017 in the Korean Intellectual Property Office, the contents of both of which are incorporated herein by reference.

TECHNICAL FIELD

The disclosure relates to a drying apparatus and a method for controlling the same, and more particularly, to a drying apparatus using a vapor compression type heat pump system and a method for controlling the same.

BACKGROUND ART

A dryer using a vapor compression type heat pump system requires a compressor, a condenser, and expansion apparatus, and an evaporator to produce necessary high-temperature air. Therefore, the dryer using the vapor compression type heat pump system is essential to optimize a design of the apparatuses (compressor, condenser, expansion apparatus, and evaporator) that constitutes the system, and in particular, optimally adjusting an operating frequency of the compressor that compresses a refrigerant is an important factor in terms of drying efficiency and energy efficiency of the dryer.

However, conventionally, because the operating frequency of the compressor is fixed regardless of a drying state of an object to be dried, a performance of the dryer decreases, and accordingly, there is a problem in that it is impossible to provide an optimal driving control method according to a drying course input by a user.

DISCLOSURE

Technical Problem

The disclosure provides a drying apparatus that adjusts an operating frequency of a compressor according to a drying state of an object to be dried, and a method for controlling the same.

Technical Solution

According to an embodiment of the disclosure, a drying apparatus includes: a drum; a compressor configured to compress a refrigerant; a first temperature sensor configured to be provided at an air outlet of the drum; a second temperature sensor configured to be provided at a refrigerant outlet of the compressor; and a processor configured to obtain an operating frequency of the compressor by comparing a first temperature sensed by the first temperature sensor with a predetermined threshold temperature based on a drying process for an object to be dried being started, and adjust the operating frequency of the compressor based on a third temperature calculated based on the first temperature and a second temperature, based on the second temperature sensed by the second temperature sensor reaching a predetermined first target temperature.

The processor may be configured to: adjust the operating frequency of the compressor based on the third temperature, based on a first condition that the second temperature sensed by the second temperature sensor reaches the predetermined first target temperature and the first temperature is less than a predetermined first threshold temperature or is equal to or higher than a predetermined second threshold temperature higher than the predetermined first threshold temperature being satisfied, and adjust the operating frequency of the compressor based on the obtained operating frequency, based on a second condition that the second temperature sensed by the second temperature sensor reaches the predetermined first target temperature and the first temperature is the predetermined first threshold temperature or more and less than the predetermined second threshold temperature being satisfied.

The processor may be configured to adjust the operating frequency of the compressor based on a difference value between the third temperature and a predetermined second target temperature, based on the first condition being satisfied.

The drying apparatus may further include a storage configured to store an operating frequency corresponding to each difference value between the third temperature and the predetermined second target temperature.

The processor may be configured to identify the operating frequency corresponding to the difference value between the third temperature and the predetermined second target temperature from the storage to adjust the operating frequency of the compressor, based on the first condition being satisfied.

The processor may be configured to multiply the obtained operating frequency by a predetermined ratio to adjust the operating frequency of the compressor to an operating frequency lower than the obtained operating frequency, based on the second condition being satisfied.

The processor may be configured to return the operating frequency of the compressor to the obtained operating frequency, based on the second condition being satisfied and the third temperature being less than a predetermined second target temperature.

The predetermined second target temperature may be differently set according to a course type of the drying process.

The predetermined threshold temperature may include a third threshold temperature and a fourth threshold temperature higher than the third threshold temperature.

The processor may be configured to: obtain a first operating frequency, based on the first temperature being less than the third threshold temperature, obtain a second operating frequency lower than the first operating frequency, based on the first temperature being the third threshold temperature or more and less than the fourth threshold temperature, and obtain a third operating frequency lower than the second operating frequency, based on the first temperature being the fourth threshold temperature or more.

The drying apparatus may further include a display.

The processor may be configured to provide a drying state of the object to be dried through the display based on the third temperature.

The predetermined first target temperature may be differently set according to a course type of the drying process.

According to another embodiment of the disclosure, a method for controlling a drying apparatus includes: obtaining an operating frequency of a compressor that compresses a refrigerant by comparing a first temperature sensed by a first temperature sensor provided at an air outlet of a drum with a predetermined threshold temperature, based on a drying process for the object to be dried being started; and adjusting the operating frequency of the compressor based on a third temperature calculated based on the first temperature and a second temperature, based on the second temperature sensed by a second temperature sensor provided at a refrigerant outlet of the compressor reaching a predetermined first target temperature.

In the adjusting of the operating frequency, the operating frequency of the compressor may be adjusted based on the third temperature, based on a first condition that the second temperature sensed by the second temperature sensor reaches the predetermined first target temperature and the first temperature is less than a predetermined first threshold temperature or is equal to or higher than a predetermined second threshold temperature higher than the predetermined first threshold temperature being satisfied, and the operating frequency of the compressor may be adjusted based on the obtained operating frequency, based on a second condition that the second temperature sensed by the second temperature sensor reaches the predetermined first target temperature and the first temperature is the predetermined first threshold temperature or more and less than the predetermined second threshold temperature being satisfied.

In the adjusting of the operating frequency, the operating frequency of the compressor may be adjusted based on a difference value between the third temperature and a predetermined second target temperature, based on the first condition being satisfied.

In the adjusting of the operating frequency, a pre-stored operating frequency corresponding to the difference value between the third temperature and the predetermined second target temperature may be identified to adjust the operating frequency of the compressor, based on the first condition being satisfied.

In the adjusting of the operating frequency, the obtained operating frequency may be multiplied by a predetermined ratio to adjust the operating frequency of the compressor to an operating frequency lower than the obtained operating frequency, based on the second condition being satisfied.

The method may further include returning the operating frequency of the compressor to the obtained operating frequency, based on the second condition being satisfied and the third temperature being less than a predetermined second target temperature.

The predetermined second target temperature may be differently set according to a course type of the drying process.

The predetermined threshold temperature may include a third threshold temperature and a fourth threshold temperature higher than the third threshold temperature.

In the adjusting of the operating frequency, a first operating frequency may be obtained based on the first temperature being less than the third threshold temperature, a second operating frequency lower than the first operating frequency may be obtained based on the first temperature being the third threshold temperature or more and less than the fourth threshold temperature, and a third operating frequency lower than the second operating frequency may be obtained based on the first temperature being the fourth threshold temperature or more.

The method may further include providing a drying state of the object to be dried based on the third temperature.

The predetermined first target temperature may be differently set according to a course type of the drying process.

Advantageous Effects

According to the diverse embodiments of the disclosure as described above, because the drying apparatus obtains or adjusts the optimal operating frequency of the compressor according to the drying state of the object to be dried and operates the compressor according to the compression frequency, the drying efficiency and the energy efficiency are improved.

BEST MODE

Mode for Invention

Figure 1:
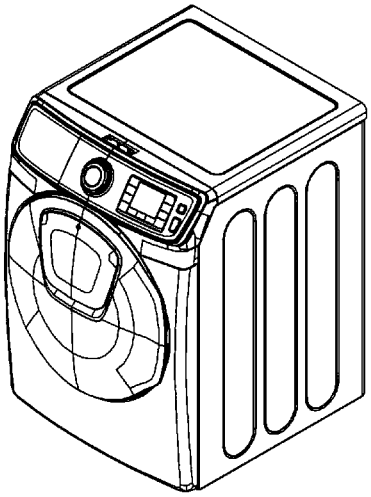
FIG. 1 is a schematic diagram for describing a drying apparatus according to an embodiment of the disclosure.

Hereinafter, the disclosure will be described in detail with reference to the drawings. In describing the disclosure, when it is decided that a detailed description for the known functions or configurations related to the disclosure may unnecessarily obscure the gist of the disclosure, the detailed description thereof will be omitted. In addition, the following embodiments may be modified to several different forms, and the scope and spirit of the disclosure are not limited to the following embodiments. Rather, these embodiments make the disclosure thorough and complete, and are provided in order to completely transfer the technical spirit of the disclosure to those skilled in the art.

In addition, the meaning that "comprises" any component means that other components are not excluded but may be further included, unless explicitly described otherwise. Further, various elements and regions in the drawings are schematically drawn. Therefore, the technical spirit of the disclosure is not limited by the relative size or spacing drawn in the accompanying drawings.

Hereinafter, the disclosure will be described in detail with reference to the accompanying drawings.

FIG. 1 is a schematic diagram for describing a drying apparatus according to an embodiment of the disclosure.

A drying apparatus 100 means an apparatus for drying an object to be dried by supplying high-temperature air into a drum while rotating the drum accommodating the object to be dried. The drying apparatus 100 according to the disclosure uses a vapor compression type heat pump system, and thus may include a compressor, a condenser, an expansion apparatus, and an evaporator.

Specifically, the vapor compression type heat pump system performs a drying operation by raising a temperature of the air introduced into the drum in which the object to be dried is accommodated by heat generated in a liquefaction process of a vaporized refrigerant.

Specifically, the evaporator vaporizes a liquid refrigerant by receiving the liquid refrigerant decompressed to low temperature and low pressure through the expansion apparatus and exchanging heat with a surrounding space. The compressor compresses the refrigerant by applying pressure to the refrigerant vaporized by the evaporator. The compressed gaseous refrigerant is delivered to the condenser. The condenser releases heat by liquefying the delivered refrigerant, thereby raising the temperature inside and outside the condenser. Meanwhile, the air inside the drying apparatus 100 becomes high-temperature air while passing through an outer surface of the condenser by an air circulation apparatus. As the high-temperature air is introduced into the drum with the object to be dried, the object to be dried is dried by high temperature, and the circulation of the refrigerant and air may be periodically repeated.

In particular, the drying apparatus 100 according to an embodiment of the disclosure may provide an optimal operation control method by adjusting an operating frequency of the compressor according to a drying state of laundry. Hereinafter, diverse embodiments of the disclosure will be described in detail with reference to the drawings.

Figure 2A:
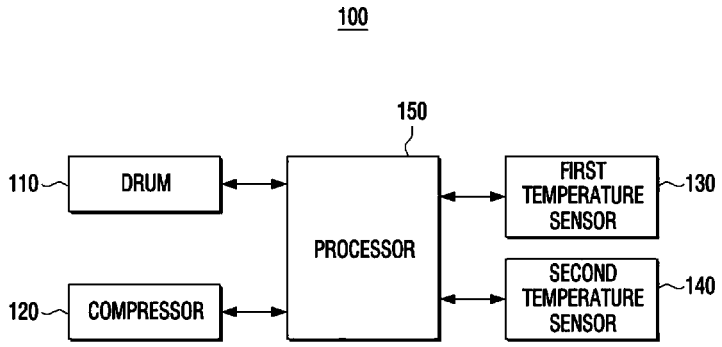
FIGS. 2A and 2B are block diagrams illustrating a configuration of the drying apparatus according to an embodiment of the disclosure.
Figure 2B:
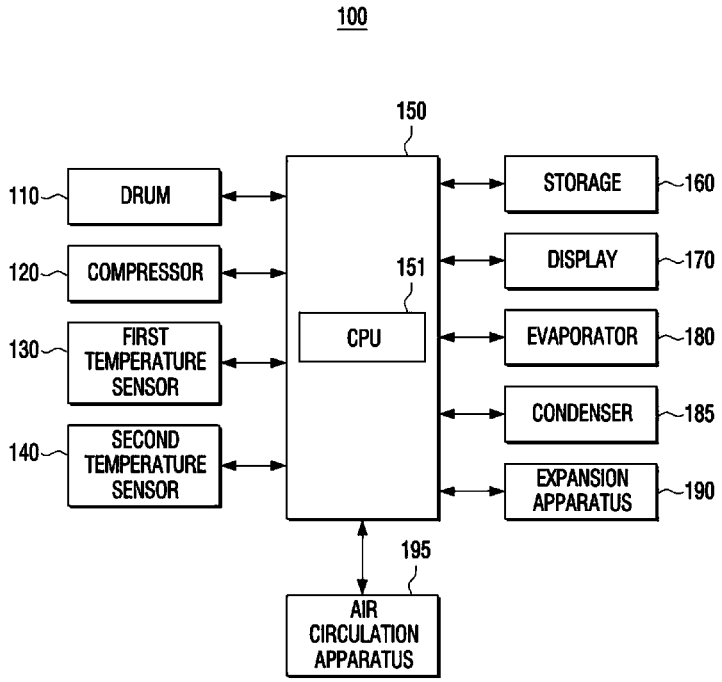

FIGS. 2A and 2B are block diagrams illustrating a configuration of the drying apparatus according to an embodiment of the disclosure.

Referring to FIG. 2A, the drying apparatus 100 includes a drum 110, a compressor 120, a first temperature sensor 130, a second temperature sensor 140, and a processor 150.

The drum 110 is a space in which the object to be dried is accommodated and is dried. Specifically, the air heated by passing through an exterior of the condenser by an air circulation apparatus 195 is introduced into the drum 110 to dry the accommodated object to be dried.

The compressor 120 compresses a refrigerant and delivers the compressed refrigerant to a condenser (not illustrated). The compressor 120 may be implemented as an inverter compressor capable of varying a drying capacity, but is not limited thereto. For example, the compressor 120 performs operation by rotating a provided motor based on an operating frequency provided from the processor 150.

The drying apparatus 100 according to an embodiment of the disclosure may adjust the degree of compression (e.g., the amount of compression) of the refrigerant by adjusting the operating frequency of the compressor 120 based on the drying state of the object to be dried. For example, the drying apparatus 100 may adjust the operating frequency of the compressor 120 relatively high when the object to be dried contains a relatively large amount of moisture, and adjust the operating frequency of the compressor 120 relatively low when the object to be dried contains a relatively small amount of moisture.

To this end, the drying apparatus 100 may include the first temperature sensor 130 and the second temperature sensor 140.

The first temperature sensor 130 may be provided at an air outlet of the drum 110. The first temperature sensor 130 may sense a temperature of air discharged from the drum 110. The first temperature sensor 130 may be implemented as a thermal sensor, but is not limited thereto.

The second temperature sensor 140 may be provided at a refrigerant outlet of the compressor 120. The second temperature sensor 140 may sense a temperature of a refrigerant discharged from the compressor 120. The second temperature sensor 140 may be implemented as a thermal sensor, but is not limited thereto.

The processor 150 controls an overall operation of the drying apparatus 100.

According to an embodiment, the processor 150 may include one or more of a central processing unit (CPU), a micro controller unit (MCU), a micro processing unit (MPU), a controller, an application processor (AP), a communication processor (CP), and an ARM processor, or may be defined as the corresponding term. In addition, the processor 150 may also be implemented as a system-on-chip (SoC) or a large scale integration (LSI) in which a processing algorithm is embedded, and may also be implemented in the form of a field programmable gate array (FPGA).

When a drying process for the object to be dried accommodated in the drum 110 is started, the processor 150 may obtain the operating frequency of the compressor 120 by comparing a first temperature sensed by the first temperature sensor 130 with a predetermined threshold temperature. Here, the first temperature is the air temperature at which the air introduced into the drum 110 contacts the object to be dried and is discharged from the air outlet of the drum 110.

For example, the processor 150 may determine the operating frequency of the compressor 120 as an A value in a case in which the drying process is started according to a user command, and the temperature of the air discharged from the air outlet of the drum 110 is lower than the predetermined threshold temperature, and may determine the operating frequency of the compressor 120 as a B value lower than the A value in a case in which the temperature of the air discharged from the air output of the drum 110 is higher than the predetermined threshold temperature. In this case, the A value and the B value may be pre-stored, but may also be calculated by a predetermined mathematical expression, algorithm, or the like.

In this case, the processor 150 may transmit a specific operating frequency (e.g., the A value or the B value described above) obtained by comparing the first temperature with the predetermined threshold temperature to the compressor 120 until the second temperature sensed by the second temperature sensor 140 reaches a predetermined first target temperature. In this case, the compressor 120 performs operation based on the specific operating frequency transmitted from the processor 150. Here, the second temperature may be a temperature at which the temperature of the vaporized refrigerant discharged from the compressor 120 is sensed. As the second temperature is higher, the temperature of the refrigerant discharged from the condenser (not illustrated) is higher, and thus the temperature of the air introduced into the drum 110 also increases.

Here, the first target temperature may be a temperature set to maintain the operating frequency of the compressor 120 at the obtained operating frequency in an initial drying section, that is, a first section, and to reduce the operating frequency of the compressor 120 in order to prevent unnecessary power consumption of the drying apparatus 100 when drying of the object to be dried is progressed to some extent. Here, the first target temperature may be calculated by an experiment or the like in consideration of a drying state and a power consumption state and pre-stored, or may be calculated by a predetermined mathematical expression, algorithm, or the like.

The processor 150 may periodically obtain the temperatures sensed by the first temperature sensor 130 and the second temperature sensor 140 or obtain the temperatures sensed by the first temperature sensor 130 and the second temperature sensor 140 when a predetermined event occurs.

Hereinafter, for convenience of explanation, a section in which the operating frequency of the compressor 120 is obtained by comparing the first temperature sensed by the first temperature sensor 130 with the predetermined threshold temperature will be referred to as a first section.

According to an embodiment, the predetermined first target temperature may be differently set according to a course type of the drying process.

For example, because a speed course needs to end the drying process within a short time, a predetermined first target temperature of the speed course may be higher than a predetermined first target temperature of a standard course. As an example, the predetermined first target temperature of the speed course may be 80° C., and the predetermined first target temperature of the standard course may be 65° C. Accordingly, in the case of the speed course, by operating the compressor 120 at a relatively high operating frequency until the second temperature reaches 80° C., the object to be dried may be dried by taking a shorter time than the standard course. However, the temperature value according to the drying course type is an example, and is not limited thereto.

According to an embodiment, the predetermined threshold temperature may include a third threshold temperature and a fourth threshold temperature higher than the third threshold temperature.

The processor 150 may obtain a first operating frequency when the first temperature is less than the third threshold temperature, obtain a second operating frequency lower than the first operating frequency when the first temperature is the third threshold temperature or more and less than the fourth threshold temperature, and obtain a third operating frequency lower than the second operating frequency when the first temperature is the fourth threshold temperature or more. The processor 150 may provide the obtained operating frequency to the compressor 120. The compressor 120 may perform operation based on the operating frequency provided from the processor 150 until the second temperature reaches the predetermined first target temperature.

Here, as a relatively large amount of moisture is contained in the object to be dried, the temperature of the air discharged from the outlet of the drum 110 and sensed by the first temperature sensor 130 may be measured to be relatively low. That is, when the first temperature is less than the third threshold temperature, the moisture contained in the object to be dried may be relatively large. Therefore, the processor 150 may provide the compressor 120 with the first operating frequency, which is the operating frequency higher than the second operating frequency and the third operating frequency, and the compressor 120 may operate based on the provided operating frequency. Accordingly, it is possible to increase efficiency of the drying process by allowing air having a relatively high temperature to be introduced into the drum 110.

In addition, as a relatively small amount of moisture is contained in the object to be dried, the temperature of the air discharged from the outlet of the drum 110 and sensed by the first temperature sensor 130 may be measured to be relatively high. That is, when the first temperature is the fourth threshold temperature or more, the moisture contained in the object to be dried may be relatively small. Therefore, the processor 150 may provide the compressor 120 with the third operating frequency, which is the operating frequency lower than the first operating frequency and the second operating frequency, and the compressor 120 may operate based on the provided operating frequency. Accordingly, it is possible to increase efficiency of the drying process by allowing air having a relatively low temperature to be introduced into the drum 110.

When the second temperature sensed by the second temperature sensor 140 reaches the predetermined first target temperature, the processor 150 may adjust the operating frequency of the compressor 120 based on a third temperature calculated based on the first temperature and the second temperature. Hereinafter, for convenience of explanation, the corresponding section will be referred to as a second section.

Specifically, in the second section, the processor 150 may not provide the obtained operating frequency described above to the compressor 120, but may provide the compressor 120 with an operating frequency adjusted according to a first condition or a second condition described below.

When a first condition that the second temperature sensed by the second temperature sensor 140 reaches the predetermined first target temperature and the first temperature is less than the predetermined first threshold temperature or is equal to or higher than the predetermined second threshold temperature higher than the predetermined first threshold temperature is satisfied, the processor 150 may provide the adjusted operating frequency to the compressor 120 based on the third temperature.

Alternatively, when a second condition that the second temperature sensed by the second temperature sensor 140 reaches the predetermined first target temperature and the first temperature is the predetermined first threshold temperature or more and less than the predetermined second threshold temperature is satisfied, the processor 150 may provide the obtained operating frequency to the compressor 120 and the compressor 120 may operate based on the provided operating frequency.

That is, in the second section, the operating frequency of the compressor 120 may be calculated in different methods according to the relationship between the first temperature and the predetermined first threshold temperature and the predetermined second threshold temperature.

Hereinafter, the condition that the second temperature sensed by the second temperature sensor 140 reaches the predetermined first target temperature and the first temperature is less than the predetermined first threshold temperature or is equal to or higher than the predetermined second threshold temperature higher than the predetermined first threshold temperature will be described as the first condition, and the condition that the second temperature sensed by the second temperature sensor 140 reaches the predetermined first target temperature and the first temperature is the predetermined first threshold temperature or more and less than the predetermined second threshold temperature will be described as the second condition.

When the first condition is satisfied, the processor 150 may provide the compressor 120 with an operating frequency adjusted based on a difference value between the third temperature and a predetermined second target temperature.

Here, the predetermined second target temperature may be differently set according to a course type of the drying process. For example, the predetermined second target temperature of a standard course may be 35° C., the predetermined second target temperature of an eco course may be 25° C., and the predetermined second target temperature of a speed course may be 45° C. However, the temperature value according to the drying course type is an example, and is not limited thereto.

When the first condition is satisfied, the processor 150 may identify an operating frequency corresponding to the difference value between the third temperature and the predetermined second target temperature from a storage 160, and provide the identified operating frequency to the compressor 120.

It will be described in detail through Mathematical expressions 1 to 3 below.

$$T\mathrm{Dry}_n = T\mathrm{Dis}_n - T\mathrm{DrumOutAir}_n \quad \text{[Mathematical expression 1]}$$

Here, $\mathrm{TDry}_n$ is a third temperature that is periodically obtained, $\mathrm{TDis}_n$ is a second temperature that is periodically obtained, and $\mathrm{TDrumOutAir}_n$ is a first temperature that is periodically obtained. $\mathrm{TDrumOutAir}_n$ is the temperature at which the temperature of the air discharged from the air outlet of the drum 110 is obtained in the n-th, and $\mathrm{TDrumOutAir}_{n+1}$ is the temperature at which the temperature of the air discharged from the air outlet of the drum 110 is obtained in the n+1-th.

$$e_n = T\mathrm{Dry}_{target} - T\mathrm{dry}_n \quad \text{[Mathematical expression 2]}$$

Here, $\mathrm{TDry}_{target}$ means a predetermined second target temperature and $\mathrm{TDry}_n$ means the third temperature that is periodically obtained.

$$\Delta e_n = e_n - e_{n-1} \quad \text{[Mathematical expression 3]}$$

The storage 160 stores a table in which the operating frequency of the compressor 120 having a value of $e_n$ and a value of $\Delta e_n$ as variables is designated. The drying apparatus 100 may calculate the value of $e_n$ and the value of $\Delta e_n$ according to the first temperature and the second temperature periodically sensed, and the predetermined second target temperature. The drying apparatus 100 may identify the operating frequency of the compressor 120 from the table stored in the storage 160 based on the value of $e_n$ and the value of $\Delta e_n$ periodically calculated, and periodically adjust the operating frequency of the compressor 120 according to the identified operating frequency.

That is, the operating frequency of the compressor 120 that satisfies the first condition and is provided by the processor 150 may be a variable frequency that is periodically changed.

When the second condition is satisfied, the processor 150 may multiply the obtained operating frequency by a predetermined ratio to provide an operating frequency lower than the obtained operating frequency to the compressor 120.

Here, because the operating frequency adjusted by multiplying the obtained operating frequency by the predetermined ratio should be a value lower than the obtained operating frequency, the predetermined ratio may have a value of 0 or more and less than 1.

For example, it will be described under the assumption that the operating frequency obtained in the section before the second temperature reaches the predetermined first target temperature is 60 HZ and the predetermined ratio is 0.9. When the second temperature sensed by the second temperature sensor 140 reaches the predetermined first target temperature and the first temperature is the predetermined first threshold temperature or more and less than the predetermined second threshold temperature (the second condition), the processor 150 may provide the adjusted operating frequency, not the obtained operating frequency, to the compressor 120. The adjusted operating frequency is 54 Hz obtained by multiplying the predetermined ratio of 0.9 by 60 Hz. Therefore, the processor 150 may provide the adjusted operating frequency of Hz to the compressor 120, and the compressor 120 may operate at the operating frequency of 54 Hz.

When the second condition is satisfied and the third temperature is less than the predetermined second target temperature, the processor 150 may return the operating frequency of the compressor 120 to the obtained operating frequency.

For example, it will be described under the assumption that the operating frequency obtained in the section before the second temperature reaches the predetermined first target temperature is 60 HZ and the predetermined ratio is 0.9. The processor 150 may provide 60 Hz to the compressor 120 until the second temperature sensed by the second temperature sensor 140 reaches the predetermined first target temperature, and may provide the compressor 120 with the operating frequency of 54 Hz according to the above-described calculation until the third temperature reaches the predetermined second target temperature from a time point when the second temperature sensed by the second temperature sensor 140 reaches the predetermined first target temperature. When the third temperature is less than the predetermined second target temperature, the process 150 may return the operating frequency to 60 Hz corresponding to the obtained operating frequency.

Here, a section in which the operating frequency of the compressor 120 is operated at 60 Hz is the first section, a section in which the operating frequency of the compressor 120 is operated at 54 Hz is the second section, and a section in which the operating frequency of the compressor 120 is again operated at 60 Hz is the third section, and the processor 150 may provide a relatively high operating frequency to the compressor 120 in the first section and the third section in which drying efficiency is relatively low. Accordingly, the time consumed in the first section and the third section may be shortened to increase energy efficiency of the drying apparatus 100.

The processor 150 may provide a drying state of the object to be dried through a display 170 based on the third temperature.

Here, the third temperature calculated as the difference value between the first temperature and the second temperature may indicate the drying state of the object to be dried.

The processor 150 may classify the drying state into three steps according to a drying progress state of the object to be dried. A first step may be set as a starting step of the drying process in which the relatively largest amount of moisture is contained in the object to be dried, a second step may be set as an intermediate step of the drying process, and a third step may be set as the last step of the drying process in which the relatively smallest amount of moisture is contained in the object to be dried.

Specifically, when the processor 150 detects a pattern in which a drying temperature increases over a predetermined temperature for a predetermined time, the processor 150 may determine the drying state as the first step and provide an icon or a progress bar corresponding to such a pattern through the display 170. When the processor 150 detects a pattern in which the drying temperature maintains a temperature value within a predetermined temperature range for a predetermined time, the processor 150 may determine the drying state as the second step and provide an icon or a progress bar corresponding to such a pattern through the display 170. When the processor 150 detects a pattern in which a drying temperature decreases over a predetermined temperature for a predetermined time, the processor 150 may determine the drying state as the third step and provide an icon or a progress bar corresponding to such a pattern through the display 170.

FIG. 2B is a block diagram illustrating an example of detailed components of the drying apparatus of FIG. 2A.

Referring to FIG. 2B, the drying apparatus 100 includes the drum 110, the compressor 120, the first temperature sensor 130, the second temperature sensor 140, the processor 150, a storage 160, a display 170, an evaporator 180, a condenser 185, an expansion apparatus 190, and an air circulation apparatus 195. A detailed description for the components overlapped with the components illustrated in FIG. 2A among components illustrated in FIG. 2B will be omitted.

The processor 150 may execute an operating system (OS), programs, and various applications stored in the storage 160 when a predetermined event occurs. The processor 150 may include a single core, a dual core, a triple core, a quad core, and a multiple-number core thereof.

For example, a CPU 151 included in the processor 150 accesses the storage 160 to perform booting using the 0/S stored in the storage 160. In addition, the CPU 151 performs various operations using various programs, data, and the like stored in the storage 160.

The storage 160 stores an operating system (O/S), firmware, and the like for driving the drying apparatus 100. In particular, the storage 160 may store a corresponding operating frequency for each difference value between the third temperature and the predetermined second target temperature. Therefore, when a specific condition is satisfied, the drying apparatus 100 may provide the operating frequency identified in the storage 160 in which the operating frequency corresponding to the difference value between the third temperature and the predetermined second target temperature is stored to the compressor 120, and the compressor 120 may operate based on the provided operating frequency.

The display 170 may be implemented as various types of displays such as a liquid crystal display (LCD), a light emitting diode (LED), a plasma display panel (PDP), an organic light-emitting diode (OLED), a cathode ray tube (CRT), and the like, but is not limited thereto, and any device may be implemented as the display 170 as long as it is a device capable of visually displaying various information on the drying apparatus 100.

In addition, the display 170 may be implemented as a touch screen. Therefore, the display 170 may display various GUI items that may control the drying apparatus 100, and a touch signal through the touch screen may be transmitted to the processor 150 to control the drying apparatus 100.

The display 170 may display various screens. Here, the screen may include an operating state information screen of the drying apparatus 100, a drying state information screen, and a screen related to a control command input by the user. However, the screen is not limited thereto.

The evaporator 180 vaporizes a liquid refrigerant by receiving the liquid refrigerant decompressed to low temperature and low pressure through the expansion apparatus 190 and exchanging heat with a surrounding space.

The condenser 185 may liquefy the high temperature and high pressure refrigerant delivered from the compressor 120. Heat may be released from the condenser 185 by liquefying the refrigerant.

The expansion apparatus 190 may lower the pressure applied to the refrigerant. As the expansion apparatus 190, a variable expansion apparatus (electronic expansion valve) capable of controlling a flow rate of the refrigerant may be used.

The air circulation apparatus 195 adjusts an air volume by varying revolution per minute (RPM) so that the air inside the drying apparatus 100 passes through the outer surface of the condenser 185 to obtain high-temperature air. The air circulation apparatus 195 may be implemented as a fan.

Figure 3:
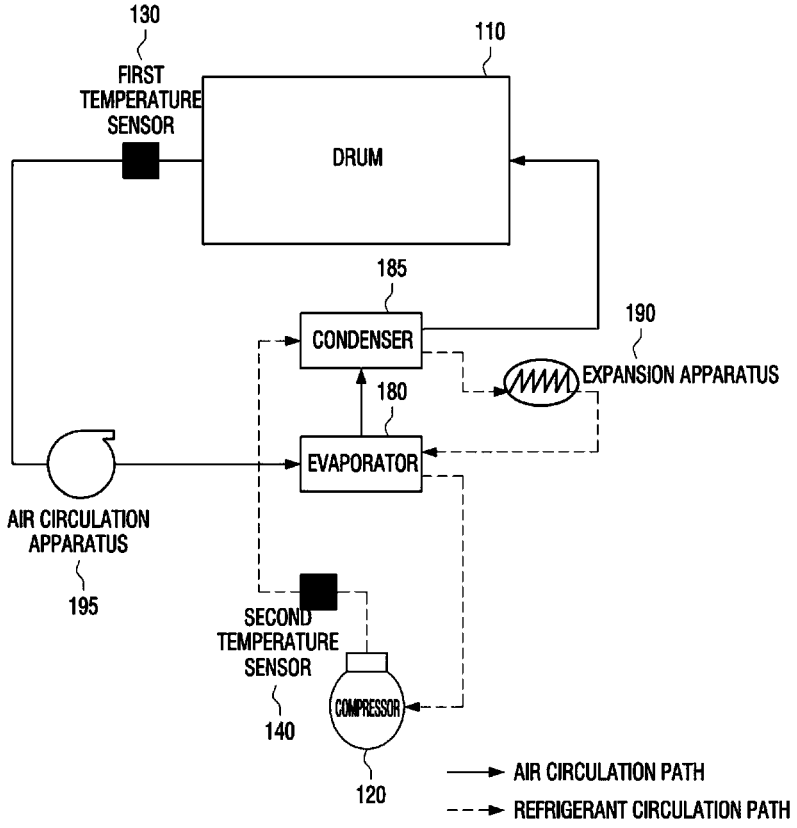
FIG. 3 is a diagram for describing a refrigerant circulation path and an air circulation path of a heat pump system according to an embodiment of the disclosure.

FIG. 3 is a diagram for describing a refrigerant circulation path and an air circulation path of a heat pump system according to an embodiment of the disclosure.

Referring to FIG. 3, the evaporator 180 vaporizes a liquid refrigerant by receiving the liquid refrigerant decompressed to low temperature and low pressure through the expansion apparatus 190 and exchanging heat with a surrounding space. The refrigerant vaporized by absorbing heat from the evaporator 180 is delivered to the compressor 120. The compressor 120 may compress the refrigerant vaporized by the evaporator 180 by applying pressure to the refrigerant. The second temperature sensor 140 may sense a temperature of a gaseous refrigerant discharged from the compressor 120. The compressed gaseous refrigerant is delivered to the condenser 185. The condenser 185 may liquefy the high temperature and high pressure refrigerant delivered from the compressor 120. Heat may be released from the condenser 185 by liquefying the refrigerant, and the temperature inside and outside the condenser 185 rises. Meanwhile, the air inside the drying apparatus 100 becomes high-temperature air while passing through an outer surface of the condenser 185 by an air circulation apparatus 195. As the high-temperature air is introduced into the drum with the object to be dried, the object to be dried may be dried by high temperature. The first temperature sensor 130 may sense a temperature of air discharged from the air outlet of the drum 110. The circulation of air inside the drying apparatus 100 may be periodically repeated.

FIG. 4 is a diagram for describing a change in an operating frequency of a compressor according to an embodiment of the disclosure.

Figure 4A:
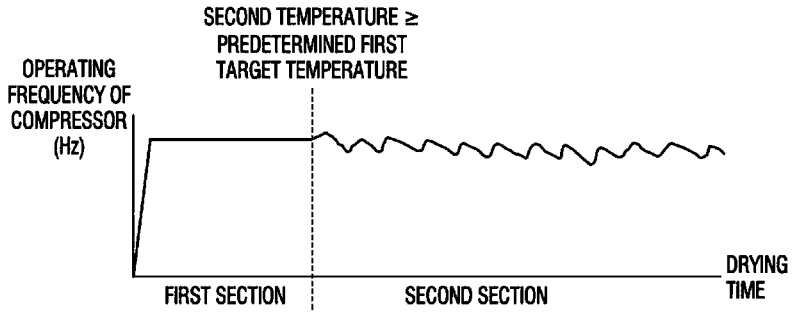
FIGS. 4A and 4B are diagrams for describing a change in an operating frequency of a compressor according to an embodiment of the disclosure.

FIG. 4A is a diagram for describing a change in an operating frequency of the compressor 120, when the condition in which the first temperature is less than the predetermined first threshold temperature or is greater than and equal to the predetermined second threshold temperature higher than the predetermined first threshold temperature is satisfied.

Until a drying process for the object to be dried accommodated in the drum 110 is started and the second temperature reaches the predetermined first target temperature, the drying apparatus 100 may obtain the operating frequency of the compressor 120 by comparing the first temperature sensed by the first temperature sensor 130 with the predetermined threshold temperature.

Hereinafter, for convenience of explanation, a section until the drying process is started and the second temperature reaches the predetermined first target temperature will be described as a first section.

In the first section, the operating frequency may be obtained by comparing the first temperature with the third threshold temperature and the fourth threshold temperature, and a detailed description thereof will be provided with reference to FIG. 5 to be described later.

When the first condition that the second temperature sensed by the second temperature sensor 140 reaches the predetermined first target temperature and the first temperature is less than the predetermined first threshold temperature or is equal to or higher than the predetermined second threshold temperature higher than the predetermined first threshold temperature is satisfied, the drying apparatus 100 may adjust the operating frequency of the compressor 120 based on the third temperature calculated based on the first temperature and the second temperature.

Hereinafter, for convenience of explanation, a section after the second temperature reaches the predetermined first target temperature will be described as a second section.

When the first condition is satisfied, the dying apparatus 100 may adjust the operating frequency of the compressor 120 in the second section based on the third temperature.

Specifically, when the first condition is satisfied, the dying apparatus 100 may adjust the operating frequency of the compressor 120 based on a difference value between the third temperature and the predetermined second target temperature. The drying apparatus 100 may calculate the operating frequency based on the first temperature, the second temperature, and the third temperature that are periodically measured. Therefore, the drying apparatus 100 may periodically adjust the operating frequency.

That is, as illustrated in the second section of FIG. 4A, the operating frequency in the second section that satisfies the first condition may be a variable frequency that is periodically changed.

A detailed description of calculating the operating frequency in the second section will be provided with reference to FIG. 6 to be described later.

Figure 4B:
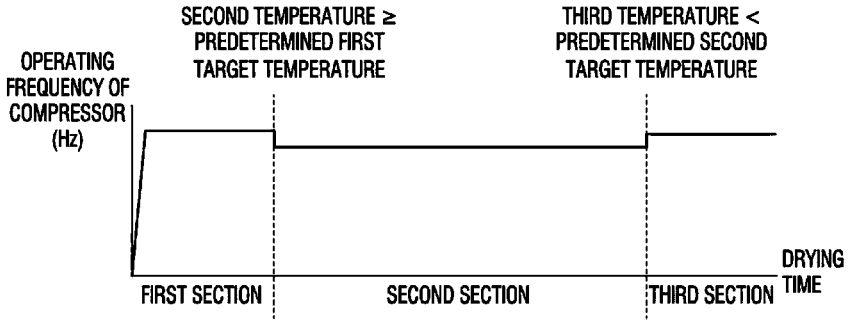

FIG. 4B is a diagram for describing a change in an operating frequency of the compressor 120, when the condition in which the first temperature is the predetermined first threshold temperature or more and less than the predetermined second threshold temperature is satisfied.

Until the drying process for the object to be dried accommodated in the drum 110 is started and the second temperature reaches the predetermined first target temperature (the first second), the drying apparatus 100 may obtain the operating frequency of the compressor 120 by comparing the first temperature sensed by the first temperature sensor 130 with the predetermined threshold temperature.

That is, the operating frequency obtained in the first section may be the same regardless of the relationship between the first temperature and the predetermined first threshold temperature and the predetermined second threshold temperature (the operating frequencies obtained in the first section of FIGS. 4A and 4B are the same).

When the second condition that the second temperature sensed by the second temperature sensor 140 reaches the predetermined first target temperature and the first temperature is the predetermined first threshold temperature or more and less than the predetermined second threshold temperature is satisfied, the drying apparatus 100 may adjust the operating frequency of the compressor 120 based on the obtained operating frequency.

When the second condition is satisfied, the drying apparatus 100 may multiply the obtained operating frequency by a predetermined ratio to adjust the operating frequency of the compressor 120 to an operating frequency lower than the obtained operating frequency.

Here, because the operating frequency adjusted by multiplying the obtained operating frequency by the predetermined ratio should be a value lower than the obtained operating frequency, the predetermined ratio may have a value of 0 or more and less than 1.

For example, it will be described under the assumption that the operating frequency obtained in the first section is 60 HZ and the predetermined ratio is 0.9. When the second temperature sensed by the second temperature sensor 140 reaches the predetermined first target temperature and the first temperature is the predetermined first threshold temperature or more and less than the predetermined second threshold temperature (the second condition), the compressor 120 may be operated at the adjusted operating frequency, not the obtained operating frequency. The adjusted operating frequency is 54 Hz obtained by multiplying the predetermined ratio of 0.9 by 60 HZ. Therefore, the compressor 120 may be operated at 54 HZ, which is the adjusted operating frequency.

That is, the operating frequency in the second section satisfying the second condition may be a fixed frequency.

When the second condition is satisfied and the third temperature is less than the predetermined second target temperature, the drying apparatus 100 may return the operating frequency of the compressor 120 to the obtained operating frequency.

Hereinafter, for convenience of explanation, a section from which the second condition is satisfied and the third temperature is less than the predetermined second target temperature will be described as a third section.

For example, it will be described under the assumption that the operating frequency obtained in the first section is 60 HZ and the predetermined ratio is 0.9. The compressor 120 may be operated at 60 Hz until the second temperature sensed by the second temperature sensor 140 reaches the predetermined first target temperature, and may be operated at the operating frequency of 54 Hz according to the above-described calculation until the third temperature reaches the predetermined second target temperature from a time point when the second temperature sensed by the second temperature sensor 140 reaches the predetermined first target temperature. When the third temperature is less than the predetermined second target temperature, the compressor 120 may be operated at 60 Hz corresponding to the obtained operating frequency.

Here, a section in which the operating frequency of the compressor 120 is operated at 60 Hz is the first section, a section in which the operating frequency of the compressor 120 is operated at 54 Hz is the second section, and a section in which the operating frequency of the compressor 120 is again operated at 60 Hz is the third section. The compressor 120 may operate at a relatively high operating frequency in the first section and the third section in which drying efficiency is relatively low. Accordingly, the time consumed in the first section and the third section may be shortened to increase energy efficiency of the drying apparatus 100.

Figure 5:
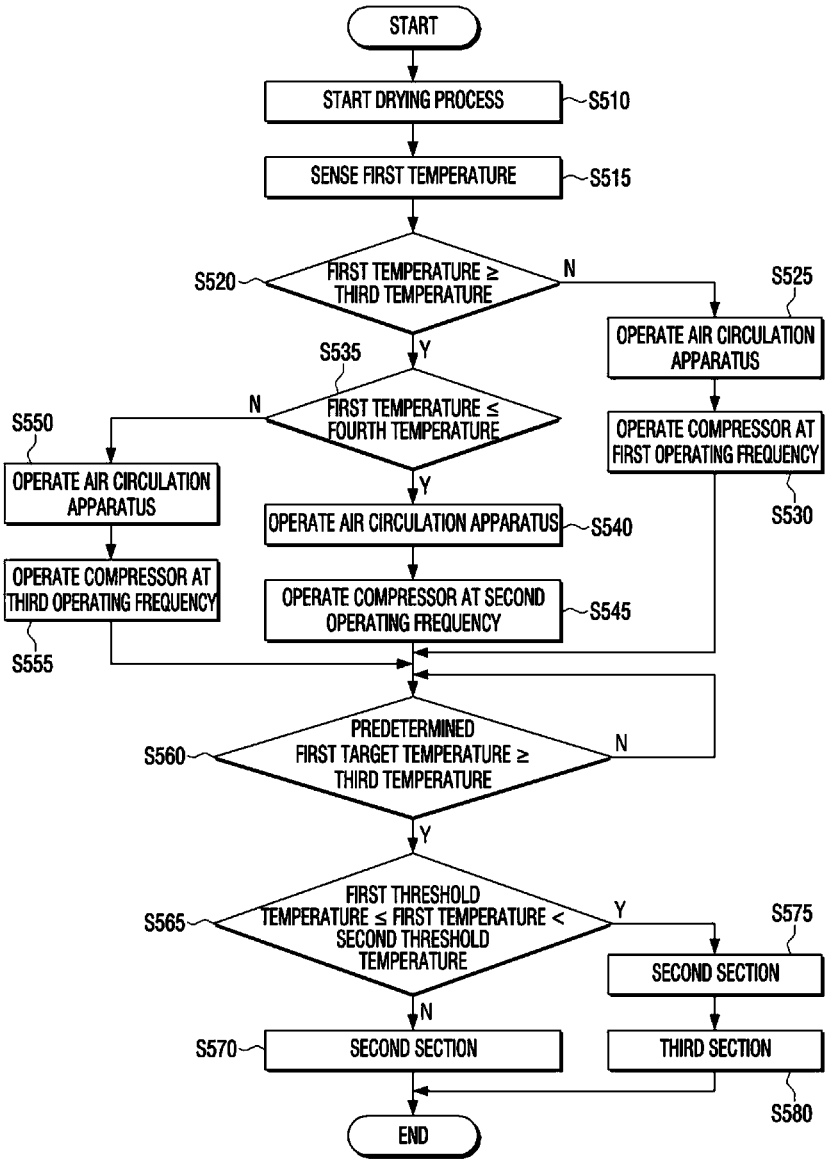
FIG. 5 is a diagram for describing a method for obtaining an operating frequency of a compressor according to an embodiment of the disclosure.

FIG. 5 is a diagram for describing a method for obtaining an operating frequency of a compressor according to an embodiment of the disclosure.

Referring to FIG. 5, the operating frequency of the compressor 120 in the first section may be obtained by comparing the first temperature sensed by the first temperature sensor 130 with the predetermined threshold temperature.

Specifically, if a drying process for an object to be dried accommodated in the drum 110 is started (S510), the drying apparatus 100 may sense a first temperature (S515). Here, the first temperature may be a temperature at which the first temperature sensor 130 senses the temperature of the air first discharged from the air outlet of the drum 110 after the drying process starts.

If the sensed first temperature is less than the third threshold temperature (N in S520), the drying apparatus 100 may operate the air circulation apparatus 195 (S525) and obtain a first operating frequency to operate the compressor 120 at the first operating frequency (S530).

If the sensed first temperature is the third threshold temperature or more and less than the fourth threshold temperature higher than the third threshold temperature (Y in S520 and Y in S535), the drying apparatus 100 may operate the air circulation apparatus 195 (S540) and obtain a second operating frequency lower than the first operating frequency to operate the compressor 120 at the second operating frequency (S545).

If the sensed first temperature is the fourth threshold temperature or more (N in S535), the drying apparatus 100 may operate the air circulation apparatus 195 (S550) and obtain a third operating frequency lower than the second operating frequency to operate the compressor 120 at the third operating frequency (S555).

Here, as a relatively more moisture is contained in the object to be dried, the temperature of the air discharged from the outlet of the drum 110 and sensed by the first temperature sensor 130 may be measured to be relatively low. That is, when the first temperature is less than the third threshold temperature, the moisture contained in the object to be dried may be relatively large. Therefore, the compressor 120 may operate at the first operating frequency, which is an operating frequency higher than the second operating frequency and the third operating frequency, to increase the efficiency of the drying process.

In addition, as a relatively small amount of moisture is contained in the object to be dried, the temperature of the air discharged from the outlet of the drum 110 and sensed by the first temperature sensor 130 may be measured to be relatively high. That is, when the first temperature is the fourth threshold temperature or more, the moisture contained in the object to be dried may be relatively small. Therefore, the compressor 120 may operate at the third operating frequency, which is an operating frequency lower than the first operating frequency and the second operating frequency, to increase the efficiency of the drying process.

If the first condition that the second temperature sensed by the second temperature sensor 140 is the predetermined first target temperature or more (Y in S560) and the first temperature is less than the predetermined first threshold temperature or is equal to or higher than the predetermined second threshold temperature higher than the predetermined first threshold temperature is satisfied (N in S565), the drying apparatus 100 may adjust the operating frequency of the compressor 120 based on the third temperature and the compressor 120 may operate at the adjusted operating frequency (S570, second section). A detailed description of calculating the operating frequency of the compressor 120 in the second section of the first condition will be provided with reference to FIG. 6 to be described later.

If the second condition that the second temperature sensed by the second temperature sensor 140 reaches the predetermined first target temperature and the first temperature is the predetermined first threshold temperature or more and less than the predetermined second threshold temperature is satisfied (Y in S565), the drying apparatus 100 may calculate the operating frequency of the compressor 120 by multiplying the operating frequency (first operating frequency, second operating frequency, or third operating frequency) obtained in the first section by a predetermined ratio, and the compressor 120 may operate at the calculated operation frequency (S575, second section). The detailed description of adjusting the operating frequency in the second section of the second condition has been provided with reference to FIG. 4B and is thus omitted.

If the second condition is satisfied and the third temperature is less than the predetermined second target temperature, the drying apparatus 100 may return the operating frequency of the compressor 120 to the operating frequency (first operating frequency, second operating frequency, or third operating frequency) obtained in the first section, and the compressor 120 may operate at the corresponding operating frequency (S580, third section). The detailed description of adjusting the operating frequency in the third section of the second condition has been provided with reference to FIG. 4B and is thus omitted.

Figure 6:
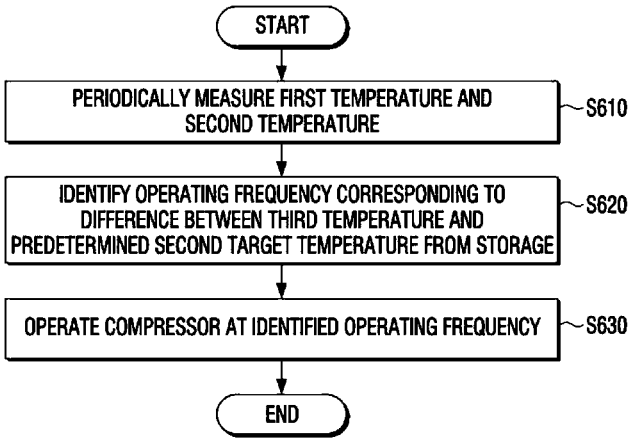
FIG. 6 is a diagram for describing adjustment of the operating frequency of the compressor according to an embodiment of the disclosure.

FIG. 6 is a diagram for describing adjustment of the operating frequency of the compressor according to an embodiment of the disclosure.

FIG. 6 is a diagram for describing a method for adjusting the operating frequency of the compressor 120 in the second section of the first condition.

If the second temperature sensed by the second temperature sensor 140 reaches the predetermined first target temperature and the first temperature is less than the predetermined first threshold temperature or is equal to or higher than the predetermined second threshold temperature higher than the predetermined first threshold temperature (the first condition), the drying apparatus 100 may adjust the operating frequency of the compressor 120 based on the third temperature calculated based on the first temperature and the second temperature.

Specifically, the drying apparatus 100 may periodically obtain the first temperature and the second temperature measured by the first temperature sensor and the second temperature sensor (S610).

If the first condition is satisfied, the dying apparatus 100 may identify an operating frequency corresponding to a difference value between the third temperature and the predetermined second target temperature from the table stored in the storage 160 as the operating frequency of the compressor 120 (S620). The drying apparatus 100 may operate the compressor 120 at the identified operating frequency (S630).

It will be described in detail through Mathematical expressions 1 to 3 below.

$$T\mathrm{Dry}_n = T\mathrm{Dis}_n - T\mathrm{DrumOutAir}_n \quad \text{[Mathematical expression 1]}$$

Here, $\mathrm{TDry}_n$ is a third temperature that is periodically obtained, $\mathrm{TDis}_n$ is a second temperature that is periodically obtained, and $\mathrm{TDrumOutAir}_n$ is a first temperature that is periodically obtained. $\mathrm{TDrumOutAir}_n$ is the temperature at which the temperature of the air discharged from the air outlet of the drum 110 is obtained in the n-th, and $\mathrm{TDrumOutAir}_{n+1}$ is the temperature at which the temperature of the air discharged from the air outlet of the drum 110 is obtained in the n+1-th.

$$e_n = T\mathrm{Dry}_{target} - T\mathrm{Dry}_n \quad \text{[Mathematical expression 2]}$$

Here, $\mathrm{TDry}_{target}$ means a predetermined second target temperature and $\mathrm{TDry}_n$ means the third temperature that is periodically obtained.

$$\Delta e_n = e_n - e_{n-1} \quad \text{[Mathematical expression 3]}$$

The storage 160 stores a table in which the operating frequency of the compressor 120 having a value of $e_n$ and a value of $\Delta e_n$ as variables is designated. The drying apparatus 100 may calculate the value of $e_n$ and the value of $\Delta e_n$ according to the first temperature and the second temperature periodically sensed, and the predetermined second target temperature. The drying apparatus 100 may identify the operating frequency of the compressor 120 from the table stored in the storage 160 based on the value of $e_n$ and the value of $\Delta e_n$ periodically calculated, and periodically adjust the operating frequency of the compressor 120 according to the identified operating frequency.

That is, the operating frequency of the compressor 120 that satisfies the first condition and is adjusted by the drying apparatus 100 may be a variable frequency that is periodically changed.

Figure 7:
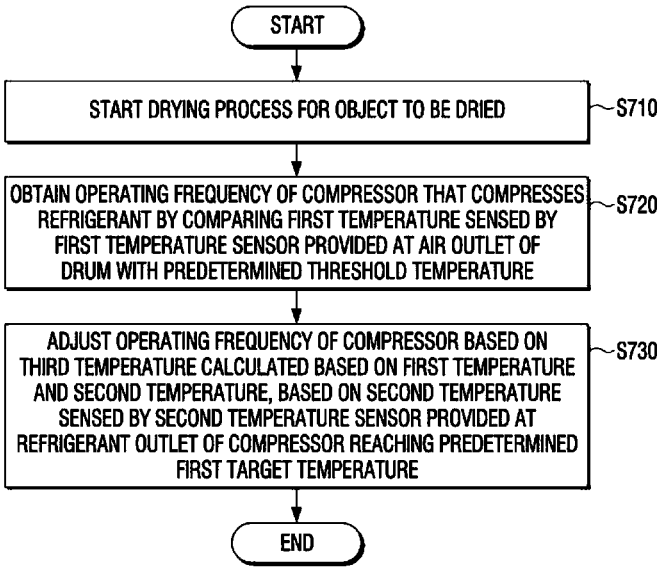
FIG. 7 is a flowchart for describing a method for controlling a drying apparatus according to an embodiment of the disclosure.

FIG. 7 is a flowchart for describing a method for controlling a drying apparatus according to an embodiment of the disclosure.

Referring to FIG. 7, if the drying process for the object to be dried accommodated in the drum 110 is started (S710), the drying apparatus 100 may obtain the operating frequency of the compressor 120 by comparing the first temperature sensed by the first temperature sensor 130 provided at the air outlet of the drum 110 with the predetermined threshold temperature (S720).

If the second temperature sensed by the second temperature sensor 140 provided at the refrigerant outlet of the compressor 120 reaches the predetermined first target temperature, the drying apparatus 100 may adjust the operating frequency of the compressor 120 based on the third temperature calculated based on the first temperature and the second temperature (S730).

A detailed operation of each step has been described above, and thus a detailed description thereof will be omitted.

Meanwhile, the diverse embodiments described above may be implemented in a computer or similar device readable recording medium using software, hardware, or a combination thereof. In some cases, the embodiments described in the disclosure may be implemented by the processor itself. According to a software implementation, the embodiments such as procedures and functions described in the disclosure may be implemented as separate software modules. Each of the software modules may perform one or more functions and operations described in the disclosure.

Meanwhile, computer instructions for performing processing operations according to the diverse embodiments of the disclosure described above may be stored in a non-transitory computer-readable medium. The computer instructions stored in the non-transitory computer-readable medium allow a specific device to perform the processing operations according to the diverse embodiments described above when being executed by a processor.

The non-transitory computer-readable medium refers to a medium that stores data semi-permanently and is read by a device, not a medium storing data for a short time such as a register, a cache, a memory, and the like. A specific example of the non-transitory computer-readable medium may include a compact disk (CD), a digital versatile disk (DVD), a hard disk, a Blu-ray disk, a universal serial bus (USB), a memory card, a read only memory (ROM), or the like.

Although the embodiments of the disclosure have been illustrated and described hereinabove, the disclosure is not limited to the abovementioned specific embodiments, but may be variously modified by those skilled in the art to which the disclosure pertains without departing from the gist of the disclosure as disclosed in the accompanying claims. These modifications should also be understood to fall within the scope and spirit of the disclosure.

The invention claimed is:

1. A drying apparatus comprising:

a drum;

a compressor configured to compress a refrigerant;

a first temperature sensor configured to be provided at an air outlet of the drum;

a second temperature sensor configured to be provided at a refrigerant outlet of the compressor; and a processor configured to obtain an operating frequency of the compressor by comparing a first temperature sensed by the first temperature sensor with a predetermined threshold temperature based on a drying process for an object to be dried being started, and adjust the operating frequency of the compressor based on a third temperature calculated based on the first temperature and a second temperature, based on the second temperature sensed by the second temperature sensor reaching a predetermined first target temperature.

2. The drying apparatus as claimed in claim 1, wherein the processor is configured to:

adjust the operating frequency of the compressor based on the third temperature, based on a first condition that the second temperature sensed by the second temperature sensor reaches the predetermined first target temperature and the first temperature is less than a predetermined first threshold temperature or is equal to or higher than a predetermined second threshold temperature higher than the predetermined first threshold temperature being satisfied, and adjust the operating frequency of the compressor based on the obtained operating frequency, based on a second condition that the second temperature sensed by the second temperature sensor reaches the predetermined first target temperature and the first temperature is the predetermined first threshold temperature or more and less than the predetermined second threshold temperature being satisfied.

3. The drying apparatus as claimed in claim 2, wherein the processor is configured to adjust the operating frequency of the compressor based on a difference value between the third temperature and a predetermined second target temperature, based on the first condition being satisfied.

4. The drying apparatus as claimed in claim 3, further comprising a storage configured to store an operating frequency corresponding to each difference value between the third temperature and the predetermined second target temperature, wherein the processor is configured to identify the operating frequency corresponding to the difference value between the third temperature and the predetermined second target temperature from the storage to adjust the operating frequency of the compressor, based on the first condition being satisfied.

5. The drying apparatus as claimed in claim 2, wherein the processor is configured to multiply the obtained operating frequency by a predetermined ratio to adjust the operating frequency of the compressor to an operating frequency lower than the obtained operating frequency, based on the second condition being satisfied.

6. The drying apparatus as claimed in claim 2, wherein the processor is configured to return the operating frequency of the compressor to the obtained operating frequency, based on the second condition being satisfied and the third temperature being less than a predetermined second target temperature.

7. The drying apparatus as claimed in claim 3, wherein the predetermined second target temperature is differently set according to a course type of the drying process.

8. The drying apparatus as claimed in claim 1, wherein the predetermined threshold temperature includes a third threshold temperature and a fourth threshold temperature higher than the third threshold temperature, and the processor is configured to:

obtain a first operating frequency, based on the first temperature being less than the third threshold temperature, obtain a second operating frequency lower than the first operating frequency, based on the first temperature being the third threshold temperature or more and less than the fourth threshold temperature, and obtain a third operating frequency lower than the second operating frequency, based on the first temperature being the fourth threshold temperature or more.

9. The drying apparatus as claimed in claim 1, further comprising a display, wherein the processor is configured to provide a drying state of the object to be dried through the display based on the third temperature.

10. The drying apparatus as claimed in claim 1, wherein the predetermined first target temperature is differently set according to a course type of the drying process.

11. A method for controlling a drying apparatus, the method comprising:

obtaining an operating frequency of a compressor that compresses a refrigerant by comparing a first temperature sensed by a first temperature sensor provided at an air outlet of a drum accommodating an object to be dried with a predetermined threshold temperature, based on a drying process for the object to be dried being started; and adjusting the operating frequency of the compressor based on a third temperature calculated based on the first temperature and a second temperature, based on the second temperature sensed by a second temperature sensor provided at a refrigerant outlet of the compressor reaching a predetermined first target temperature.

12. The method as claimed in claim 11, wherein in the adjusting of the operating frequency, the operating frequency of the compressor is adjusted based on the third temperature, based on a first condition that the second temperature sensed by the second temperature sensor reaches the predetermined first target temperature and the first temperature is less than a predetermined first threshold temperature or is equal to or higher than a predetermined second threshold temperature higher than the predetermined first threshold temperature being satisfied, and the operating frequency of the compressor is adjusted based on the obtained operating frequency, based on a second condition that the second temperature sensed by the second temperature sensor reaches the predetermined first target temperature and the first temperature is the predetermined first threshold temperature or more and less than the predetermined second threshold temperature being satisfied.

13. The method as claimed in claim 12, wherein in the adjusting of the operating frequency, the operating frequency of the compressor is adjusted based on a difference value between the third temperature and a predetermined second target temperature, based on the first condition being satisfied.

14. The method as claimed in claim 13, wherein in the adjusting of the operating frequency, a pre-stored operating frequency corresponding to the difference value between the third temperature and the predetermined second target temperature is identified to adjust the operating frequency of the compressor, based on the first condition being satisfied.

15. The method as claimed in claim 12, wherein in the adjusting of the operating frequency, the obtained operating frequency is multiplied by a predetermined ratio to adjust the operating frequency of the compressor to an operating frequency lower than the obtained operating frequency, based on the second condition being satisfied.

* * * * *